United States Patent [19]

Hardy

[11] Patent Number: 4,722,153

[45] Date of Patent: Feb. 2, 1988

[54] COVER JOINTS FOR MASONRY AND SHEET MATERIAL STRUCTURES

[75] Inventor: Samuel F. Hardy, Chadstone, Australia

[73] Assignee: Eighteenth Yeneb Pty. Ltd., Chadstone, Australia

[21] Appl. No.: 821,015

[22] Filed: Jan. 21, 1986

[30] Foreign Application Priority Data

Jan. 30, 1985 [AU] Australia ..... PG9072
Mar. 12, 1985 [AU] Australia ..... PG9666

[51] Int. Cl.[4] ..... E04B 2/00

[52] U.S. Cl. ..... 52/255; 52/254; 52/256; 52/258

[58] Field of Search ..... 52/254, 255, 256, 258, 52/743, 746

[56] References Cited

U.S. PATENT DOCUMENTS

| | | | |
|---|---|---|---|
| 1,537,758 | 5/1925 | Fischer | 52/258 |
| 2,643,423 | 6/1953 | Brendel | 52/255 |
| 2,796,641 | 6/1957 | Wollaeger | 52/255 |
| 2,904,856 | 9/1956 | Robinson | 52/255 |
| 3,201,910 | 8/1965 | Keesee | 52/255 |
| 3,398,494 | 8/1968 | Larson | 52/255 |
| 3,964,220 | 6/1976 | Rutkowski et al. | 52/256 |
| 4,074,478 | 2/1978 | Rutherford | 52/256 |

FOREIGN PATENT DOCUMENTS

| | | | |
|---|---|---|---|
| 1298439 | 6/1962 | France | 52/255 |

*Primary Examiner*—William F. Pate, III
*Assistant Examiner*—Caroline D. Dennison
*Attorney, Agent, or Firm*—Gifford, Groh, VanOphem, Sheridan, Sprinkle and Dolgorukov

[57] ABSTRACT

A cover joint for masonry and sheet material structures and a method of forming the joint between two structure surfaces comprising attaching a cover strip member having inner and outer leg parts at the joint by firstly securing the outer leg parts, which are provided with apertures, to the structure surfaces by settable material which extrudes through the apertures. The outer leg parts are offset from the inner leg parts to provide a space between the inner leg parts and the structure surfaces. A coating of filling and settable material is then applied over the outer leg parts to provide smooth tapered uninterrupted surfaces thereon. The cover strip member may be of planar form or in the form of an angle member.

6 Claims, 12 Drawing Figures

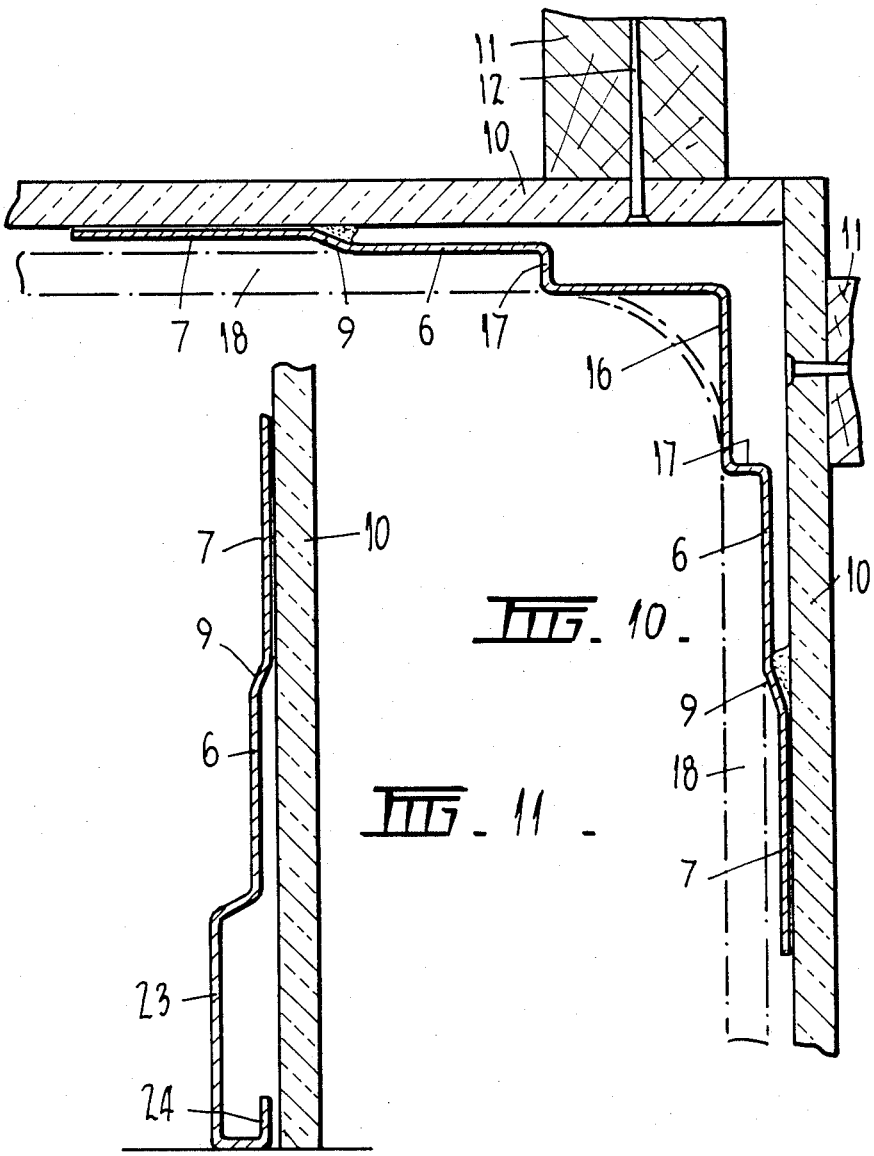
FIG. 10.
FIG. 11.
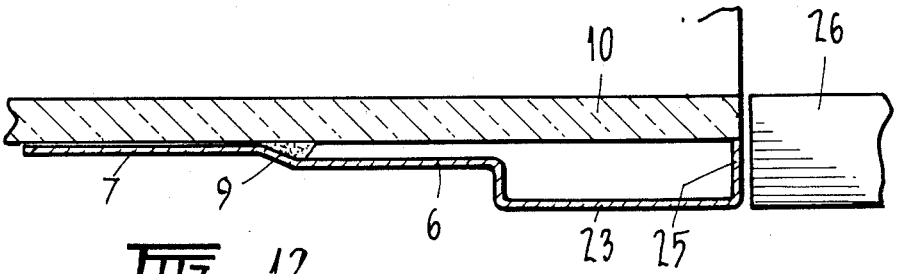
FIG. 12.

COVER JOINTS FOR MASONRY AND SHEET MATERIAL STRUCTURES

This invention relates to cover joints for structure, such as masonry and sheet material structures, and a method of forming the joints.

The invention is applicable to the covering or finishing of joints in and between walls, ceilings and the like and has particular, but not exclusive, application to the forming and finishing of angle joints between plaster board, fibre board and like structures.

The conventional method of forming and finishing angle joints between wall and ceiling structures comprises securing a metal or like angle member to and between the corner timber studs and then nailing the plaster or other material sheets through the angle member into the studs. The inside corners are then filled or taped and finished off with plaster or like coating material before sanding.

This known method suffers from a number of disadvantages in that subsequent movement or distortion of the timber studs, which is frequently the case, results in springing of the fixing nails in the sheets and resultant cracking of the angle or corner joint. Also if the corner timber studs are warped or bent to any degree, which is also frequently the case, a true and straight corner finish cannot be achieved.

This known method, with all its disadvantages, involves considerable labor and time in preparing and finishing the angle joint, and requires exacting manual work in correctly locating wall-to-wall and wall-to-ceiling sheets so as to leave as little gap as possible at the angles or corners.

The general state of the art is defined in the following patents known to the applicant: U.S. Pat. Nos. 658,387, 1,030,044, 1,537,758, 2,643,423, 2,904,856 and 2,904,992.

These prior patents disclose metal angle strips, in particular external angle strips, either directly nailed to the sheets or supporting studs or bearers, or attached to the sheets in conjunction with paper tape either above or beneath the angle strip. The disadvantages inherent in these prior disclosures are:

(a) sanding of the joint would bring up the tape especially at the edge of the metal angle strip in the internal corner;
(b) excess pressure when sanding would wear through the tape causing it to crack at the edge of the metal angle strip;
(c) the edges of the metal angle strip would cut the tape on movement of the supporting underframe;
(d) expensive and complicated configurations are utilised to allow for expansion in the joint; and
(e) their application is mainly in the provision of external corner joints and not applicable to internal corners.

It is an object of the present invention to provide a cover joint member and a method of fixing same so as to provide a joint which is of great strength and will not crack, notwithstanding movement of the timber studs, and which results in a straight true angle or corner even in the case of the corner timber studs being warped or bent.

It is also an object of the invention to provide a simple method of forming and finishing the joint or a corner which obviates the use of an external angle member and also the time consuming taping of the angle prior to the application of the filling and finishing material with its special taping tools.

It is a further object of the present invention to provide a cover joint member for use in the abovementioned method of the invention, and which allows for ease and accuracy in the application of the finishing material to the joint.

According to the invention there is provided a method of forming a cover joint between two structure surfaces comprising locating and attaching a cover strip member having outer and inner leg parts at the joint between the two surfaces by securing the outer leg parts of the cover strip member to the structure surfaces, said outer leg parts being offset from the inner leg parts to provide a space between the inner leg parts and the said structure surfaces when said member is secured to said structure surfaces, and thereafter applying a coating of filling and settable material over said outer leg parts so as to provide smooth tapered uninterrupted surfaces thereupon from the said offset regions to the structure surfaces.

The said outer leg parts and the land forming the offset may be perforated or apertured to promote initial attachment to the structure surfaces by blobs of filling and settable material applied at intervals to the structure surfaces in the region of the location of the said outer leg parts. Also in addition to the coating of filling material, a liquified coating may also be applied to provide a polished surface. The cover strip member may be in planar form or in the form of an angle member.

According to a further feature of the invention, there is provided a cover strip member for forming a joint between two structure surfaces, comprising first and outer leg parts for attachment to said surfaces and second and inner leg parts offset from the plane or planes of the said first leg parts so as to be spaced from said surfaces when the joint is formed.

Said first leg parts may be provided with apertures or perforations and the cover strip member may be in planar form or in the form of an angle member.

Further features of the invention may reside in the provision of feature angle members, feature cover strips and tile strips, cornices,.skirting and architraves.

In order that the invention and its manner of performance may be more fully understood, reference will now be made to an embodiment of the invention as illustrated in the accompanying drawings, in which:

FIG. 10 illustrates forms of the angle member as feature angles for tiled areas;

FIG. 11 illustrates a skirting member of the invention; and

FIG. 12 illustrates an architrave member of the invention.

Figure 1:
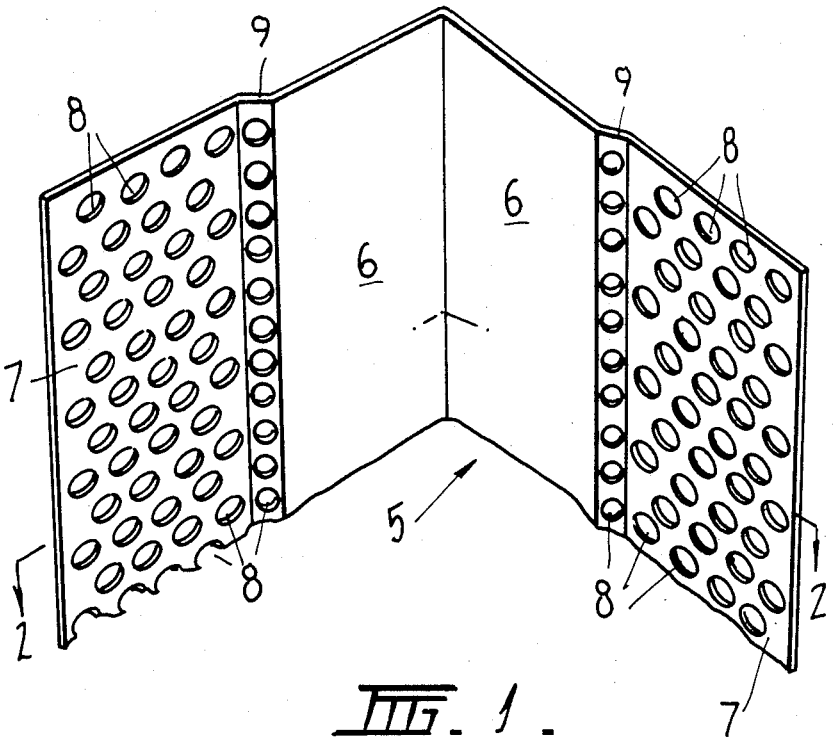
FIG. 1 is a perspective view of cover strip of the invention in the form of an internal angle member.
Figure 2:
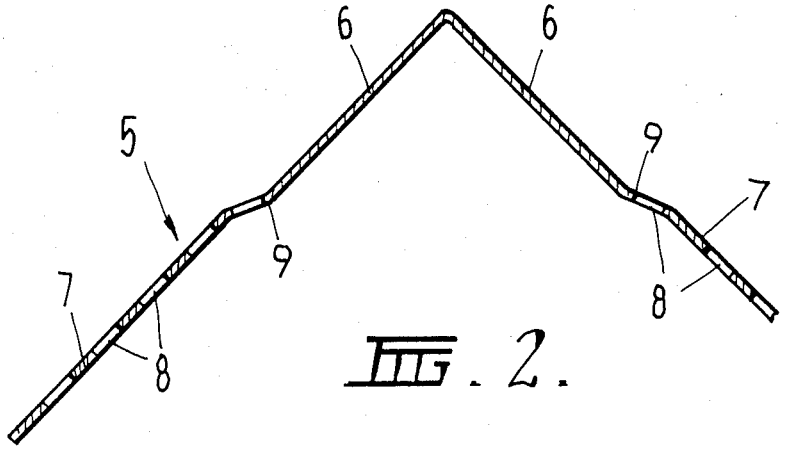
FIG. 2 is a cross-sectional view along the line 2—2 of FIG. 1 in the direction of the arrows.
Figure 3:
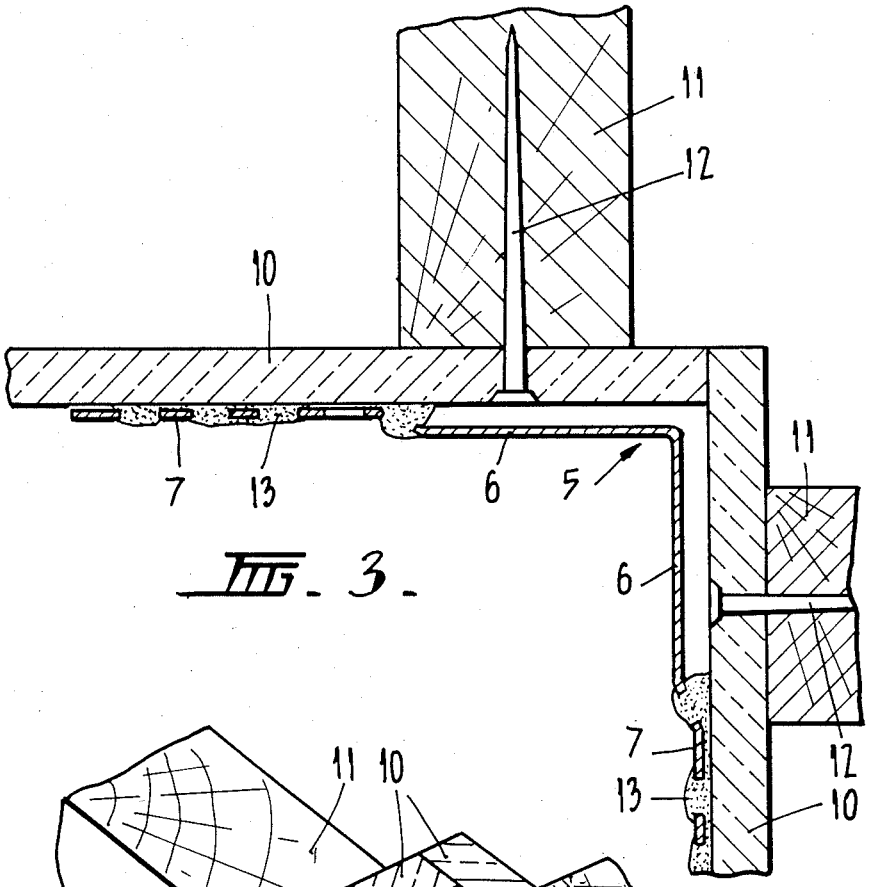
FIG. 3 is a cross-sectional view illustrating the method of locating the angle member.
Figure 4:
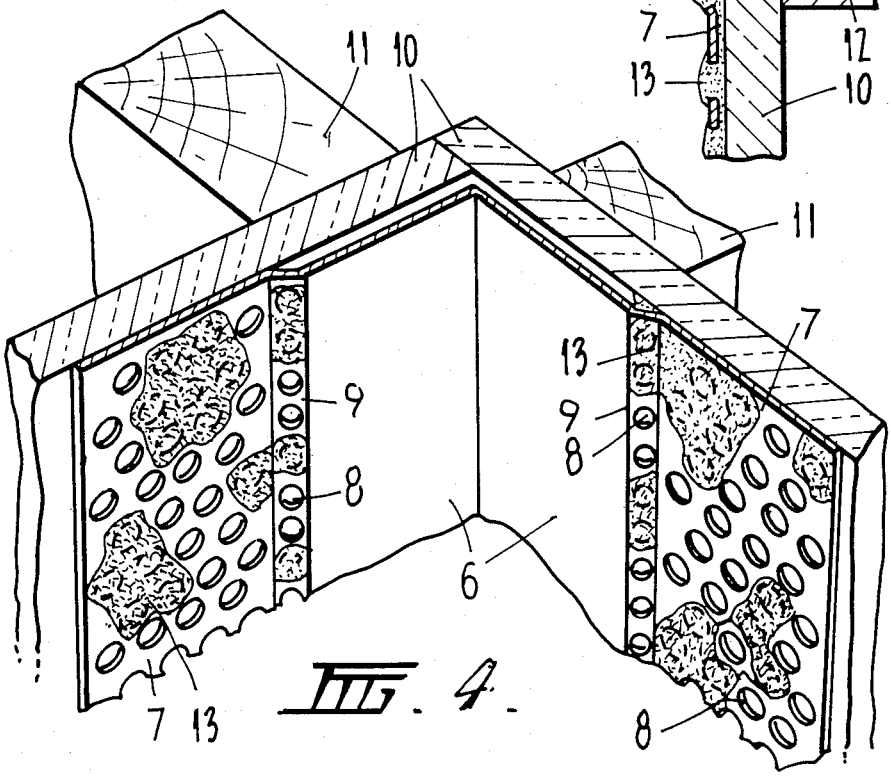
FIG. 4 is a perspective view of FIG. 3.
Figure 5:
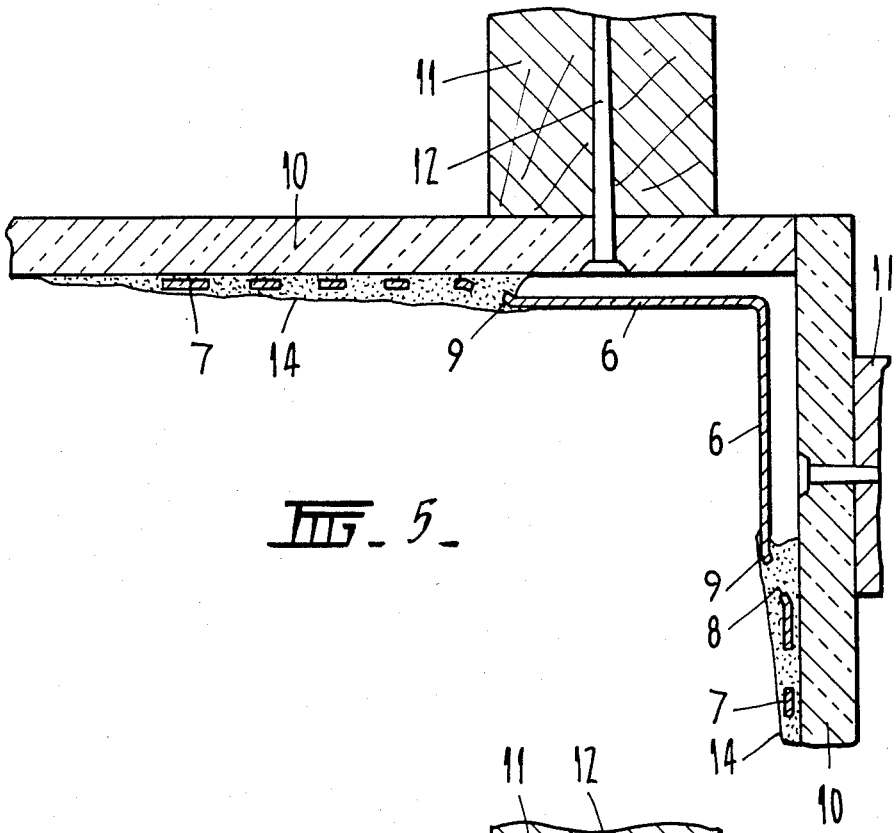
FIG. 5 is a cross-sectional view illustrating the first step of filling the angle with settable material.

Referring particularly to FIGS. 1 and 2 of the the angle member, generally indicated at 5, comprises first and inner leg parts 6 of plain configuration and second outer leg parts 7 offset at land 9 from leg parts 6 and having apertures 8 in said leg parts 7 and land 9. This angle member may be formed of metal or a suitable plastic material.

FIGS. 3 through 6 illustrate a method of locating the angle member 5 between two lining sheets 10 attached to studs or beams 11. Sheets 10 may be part of two walls, or a wall and a ceiling.

In lining a room, for example, sheets 10 are secured at the corners to corner timber studs or beams 11, and throughout their length (not shown) to similar studs or beams, by nails 12.

Angle members 5, cut to length from floor to ceiling, or wall to wall, are located in the corners on blobs 13 of settable material, such as plaster in the application of plaster boards. The blobs 13 are applied to the sheets 10 at spaced intervals, and the angle member is pushed into the corner between the sheets 10 so that the blobs 13 of settable material extrude through the apertures 8 and hold the angle member 5 in its desired location.

A first filler coat 14 of plaster is then applied by a flat stripper tool using the land 9 and the inner leg parts 6 as a straight-edge, this first coat 14 covering the apertured leg parts 7 and land 9 and tapering out to the surface of sheets 10.

Figure 6:
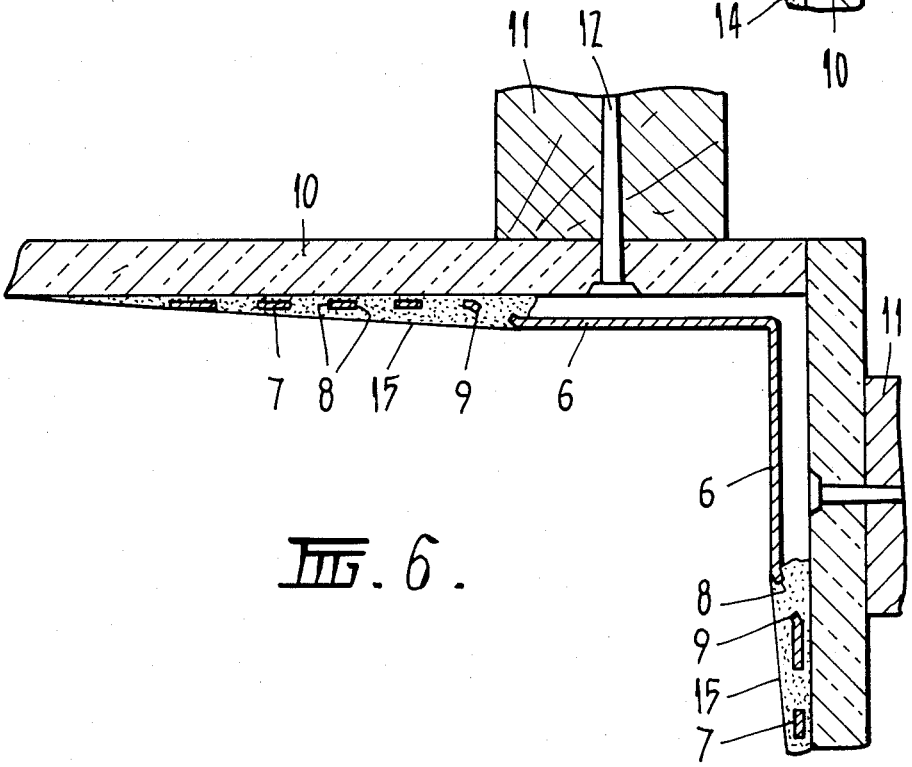
FIG. 6 is a cross-sectional view illustrating the second and finishing step.

Plaster filler coat 14 may then be sanded, or a finishing polishing coat 15 of liquified plaster is applied to the first coat to provide a smooth finished surface. The finished internal angle is illustrated in FIG. 6 with the back of the inner leg parts 6 free of plaster except in the region of lands 9, thus allowing for any movement of the studs or beams 11 or the nails 12 without disturbing the finished angle joint. The extrusion of the plaster through the apertures in land 9 provides a keying effect which obviates subsequent cracking of the plaster in the region of land 9.

The sheets 10 do not require precise fitting and a 10 mm. gap all around does not detract from the strength or quality finish of the angle joint. If the corner or angle studs 11 are not straight in the suppot frame and given an uneven line down the angle corner, the angle member of the invention is ideally suited in such circumstances. In such cases, the angle member 5 is located so that a thinner coat of filler material is applied at the high points of the studs and a heavier coat is applied at the lower points so as to provide a straight angle joint.

The angle member of the invention is ideally suited where square setting is required on the ceiling line. Conventional practice in this case is to fix the ceiling sheets first, then fit the top wall sheets tightly to the ceiling, and then push the bottom wall sheet up hard against the bottom of the top wall sheet, which is a slow laborious procedure often resulting in open wall joints.

With the present invention, measurements can be taken from floor to ceiling, and using a packing strip of say 10 mm. at the ceiling, the bottom wall sheet can be fixed first and then the top wall sheet. At the same time there is allowed a 10 mm. margin on either side of the room of the ceiling sheets resulting in an easier fitting of the ceiling sheets. As the most time-consuming requirement in square setting has been the achievement of a neat exact fitting of the sheets, it is apparent that the method of the present invention obviates to a great extent this costly labour which in the end may not result in a good finish.

Where the step of sanding the filled angles is undertaken, and this is a requirement with the conventional methods, the sanding is only required for a narrow strip of say 50 mm. and does not have to go back into the corner of the angle. This again provides for a true angle joint and saves considerable labour costs.

Whilst the above described embodiment relates to plaster or like sheeting for wall and ceiling lining, the angle member is eminently suitable for use in wet areas in conjuction with water repellent sheeting. In such an application, the angle member is fitted in position and a coating of sealant adhesive applied to completely seal the angle member in position thus obviating any saturation problems that arise in such applications.

The angle member is also suitable for use with solid plastered walls and ceilings, which when rendering is completed the angle members are fitted and set in position and provide a straight edge for final finishing.

Figure 7:
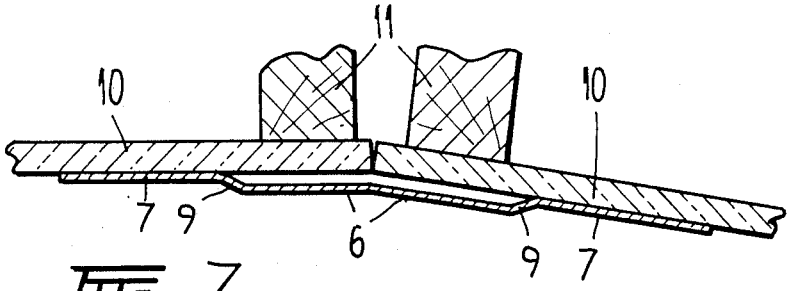
FIG. 7 illustrates the cover strip in the form of an obtuse angle member.

Referring to FIG. 7, there is illustrated the angle member 5 in obtuse angle configuration, being fixed in similar manner to the angle member 5 of FIGS. 1 to 6.

Figure 8:
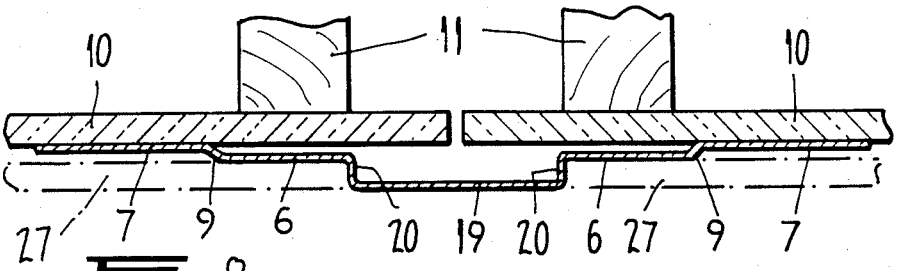
FIG. 8 illustrates a cover strip of the invention in planar form.

FIG. 8 illustrates a cover strip embodiment of the invention in planar form, and consists of inner and outer leg parts 6 and 7 as in the angle member 5, and an intermediate portion 19 having shoulders 20 against which, if desired, tiles 27 may abut on a tiled surface, whether horizontal or vertical. When the cover strip is used in conjunction with a tiled surface, the intermediate portion 19 may be colored, as by anodizing, to give a feature surface effect. The cover strip may be secured in a similar manner to angle member 5, or if tiles are to be fixed, by the tile adhesive.

Figure 9:
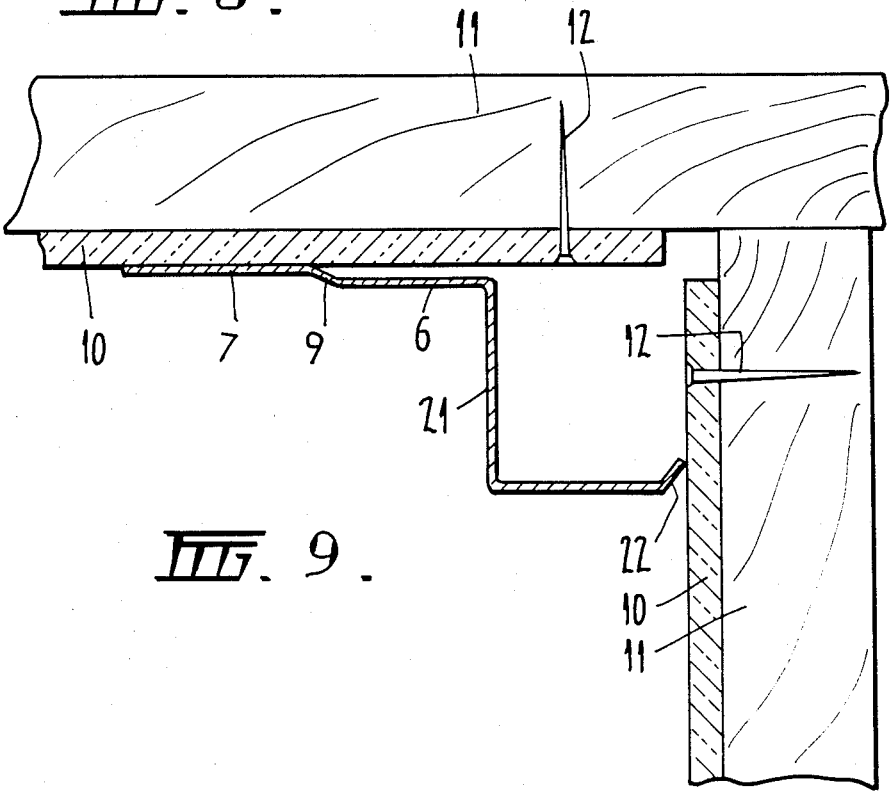
FIG. 9 illustrates a cornice member of the invention.

FIG. 9 illustrates a cornice member having inner and outer leg parts 6 and 7 attached to a boxshaped cornice 21 preferably provided with a "shadow line" inturned lip 22. In the Figure the inner and outer leg parts 6 and 7 are shown attached to a ceiling but they can equally well be attached to the wall with the shadow line at the ceiling surface. When leg parts 7 are attached to a ceiling, the weight of the ceiling will press lip 22 against the wall so as to prevent any distortion of the cornice. Whilst a box-shaped cornice is illustrated it will be appreciated that other suitable shapes may be employed.

This construction of metal cornice is most acceptable in hospitals and like buildings where plaster cornices are not used. The mitred corners at the ends of the cornice members may be filled with silicone or like material.

As described above in relation to the fixing of the angle member, the method of fixing the cornice and utilizing the weight of the ceiling would obviate the appearance of cracks as with conventional cornices and their fixing methods.

The angle members of FIG. 10 are designed as feature angles for tiled areas, and are provided with an intermediate angled or curved part 16 between inner leg parts 6, part 16 including shoulders 17 to allow tiles 18 to abut thereagainst in flush manner and be adhered thereto and to inner and outer leg parts 6 and 7 by adhesive. Outer leg parts 7 may also be adhered to sheets 10 with the tile 18 adhesive. The tiles may be ceramic, vinyl or the like and may form a wall, floor or ceiling. Parts 16 of the angle member 5 may be anodized to particular colors, such as gold, silver or brass finish.

The skirting section of FIG. 11 is somewhat similar in shape to the cornice of FIG. 10, with inner and outer leg parts 6 and 7 and box part 23 with inturned lip 24. Leg part 7 can be secured in similar fashion as with the angle member or may be fixed by adhesive as also would lip 24 if desired.

FIG. 12 illustrates an architrave section of similar shape to the skirting of FIG. 11 except that lip 24 may be omitted and leg part 25 may abut against the window or door frame 26 and can also be adhesively secured at that point.

I claim:

1. In combination:

a beam, two sheets each having a predetermined thickness, said sheets having intersecting surfaces forming a corner, a plurality of nails for affixing said sheets to said beam, a cover strip member for forming a cover joint between the two intersection surfaces of said two sheets, said cover strip comprising:

a pair of outer leg parts having a plurality of first apertures for accepting a coating material, one outer leg part adapted to abut one of said two intersecting surfaces and the other leg part adapted to abut against the other of said intersecting surfaces;

a pair of inner leg parts offset a predetermined distance from its adjacent surface to form a space which overlies said plurality of nails; and a pair of land portions, each of said pair of land portions extending diagonally between one of said pair of outer leg parts and a respective one of said pair of inner leg parts and forming an obtuse angle with each of said pair of inner leg parts, said pair of land parts having a second plurality of apertures for accepting a coating material.

2. A cover strip member according to claim 1 wherein the cover strip member is in angular strip form.

3. A cover strip member according to claim 1 wherein cover strip the member is in planar strip form.

4. A cover strip member according to claim 2 wherein said cover member includes a central portion between said pair of inner leg parts and offset therefrom in the same direction as said inner leg parts are offset from said outer leg parts.

5. A cover strip member according to claim 4 wherein said central portion is offset a predetermined distance corresponding to the thickness of a tile to be attached to said pair of outer leg parts.

6. A cover strip member according to claim 1 in the form of a cornice, skirting or architrave member.

* * * * *